US009848678B2

(12) United States Patent
Drouhard

(10) Patent No.: US 9,848,678 B2
(45) Date of Patent: Dec. 26, 2017

(54) INTERCHANGEABLE JEWELRY, PARTICULARLY A RING ASSEMBLY

(71) Applicant: Timothy J. Drouhard, Mansfield, OH (US)

(72) Inventor: Timothy J. Drouhard, Mansfield, OH (US)

( * ) Notice: Subject to any disclaimer, the term of this patent is extended or adjusted under 35 U.S.C. 154(b) by 0 days.

(21) Appl. No.: 14/959,097

(22) Filed: Dec. 4, 2015

(65) Prior Publication Data

US 2016/0183645 A1 Jun. 30, 2016

Related U.S. Application Data

(60) Provisional application No. 62/098,571, filed on Dec. 31, 2014.

(51) Int. Cl.
*A44C 17/02* (2006.01)
*A44C 9/02* (2006.01)
*A44C 9/00* (2006.01)

(52) U.S. Cl.
CPC ..... *A44C 9/02* (2013.01); *A44C 17/0208* (2013.01); *A44C 17/0216* (2013.01); *A44C 9/00* (2013.01)

(58) Field of Classification Search
CPC . A44C 17/02; A44C 17/0208; A44C 17/0216; A44C 17/0225; A44C 17/0233; A44C 17/0258; A44C 17/0266
USPC ..... 63/29.1, 26, 27
See application file for complete search history.

(56) References Cited

U.S. PATENT DOCUMENTS 253,233 A * 2/1882 Sprague ..... A44C 9/00 63/15
466,287 A * 12/1891 Berlepsch ..... A44C 17/0233 63/29.1
738,700 A * 9/1903 Roitman ..... A44C 17/0208 40/639
1,434,886 A * 11/1922 Greenfield ..... A44C 17/02 63/29.1
2,591,569 A * 4/1952 Lovell ..... A44C 17/02 63/29.1
2,594,605 A * 4/1952 Zoppelt ..... A47H 1/022 211/123
2,775,878 A * 1/1957 Eichhorn ..... A44C 17/02 63/15
4,181,230 A * 1/1980 Acuff ..... A47F 5/13 211/183
4,747,474 A * 5/1988 Kimura ..... F16F 9/461 188/267
5,077,989 A * 1/1992 Dillabaugh ..... A44C 17/0216 24/574.1
5,456,095 A * 10/1995 Tawil ..... A44C 17/0216 24/574.1

(Continued)

*Primary Examiner* — Emily Morgan
(74) *Attorney, Agent, or Firm* — Fay Sharpe LLP

(57) ABSTRACT

A ring assembly includes an annular ring platform having a recess formed in a portion thereof and a column with an opening therein. A collar is received on the ring platform and has a sleeve that mates with the column. An ornamental portion has an anchor that extends through the collar and selectively mates with the column opening. A biasing spring is received in the recess of the ring platform and urges the collar outwardly from the ring platform. The ornamental portion selectively rotates relative to the ring platform whereby the anchor locks with the column and the spring urges the ornamental portion toward locked relation therewith.

12 Claims, 19 Drawing Sheets

(56) References Cited

U.S. PATENT DOCUMENTS

| | | | | |
|---|---|---|---|---|
| 2015/0082832 | A1* | 3/2015 | Mencagli | A44B 1/32<br>63/40 |
| 2015/0257496 | A1* | 9/2015 | Swift, II | A44C 17/0208<br>63/15 |

* cited by examiner

INTERCHANGEABLE JEWELRY, PARTICULARLY A RING ASSEMBLY

This application claims the priority benefit of U.S. Provisional Application No. 62/098,571, filed Dec. 31, 2014, the entire disclosure of which is expressly incorporated herein by reference.

BACKGROUND

The present disclosure relates to jewelry, and more particularly to a ring assembly that allows a user to change a head, shoulder(s), and/or side(s) of the ring assembly or ring.

It is generally known to provide a ring in which the construct allows the setting to be selectively changed. For example, U.S. Pat. No. 5,077,989-Dillabaugh discloses a ring in which the setting may be removed and interchanged. Unfortunately, the body is substantially enlarged and undesirably protrudes upwardly.

It would be desirable to allow a customer/user to easily change between different components. For example, if a customer owns ten (10) different heads, ten (10) different shoulders, and ten (10) different sides, these thirty (30) components can create one thousand different ring styles.

The ring must be simple to use, secure, and rattle free.

SUMMARY

A ring assembly is disclosed that allows for ease of interchangeability.

A preferred ring assembly includes an annular ring platform has a recess formed in a portion thereof and a column with an opening therein. A collar is received on the ring platform and has a sleeve that mates with the column. An ornamental portion has an anchor that extends through the collar and selectively mates with the column opening. A biasing spring is received in the recess of the ring platform and urges the collar outwardly from the ring platform. The ornamental portion is selectively rotatable relative to the ring platform whereby the anchor locks with the column and the spring urges the ornamental portion toward locked relation therewith.

The ornamental portion includes a shoulder ornament portion and a head portion.

The shoulder ornament portion includes an opening that is similarly shaped to a perimeter configuration of the anchor.

The shoulder ornament portion includes a recess that selectively receives a projection extending outwardly from the collar.

The shoulder ornament portion and the head rotate together when the projection is received in the recess.

The anchor includes first and second shoulders spaced by a cross-sectional region therebetween of reduced dimension.

The biasing spring has a first arcuate portion that is centrally mounted to the ring platform, and second and third arcuate portions that are cantilever mounted to opposite ends of the first arcuate portion.

Terminal ends of the second and third arcuate portions extend outwardly through first and second slots, respectively, formed in the ring platform.

The first and second slots are disposed on opposite sides of the column.

The first arcuate portion is attached to the ring platform.

The anchor has a generally rectangular conformation in which a length dimension is greater than a width dimension.

The column opening has a generally rectangular conformation in which a length dimension is greater than a width dimension that the anchor extends therethrough only when the length dimensions are aligned with one another.

The collar has a U-shaped cross-section that is dimensioned for receipt over the outer surface of the ring platform.

The collar has an arcuate shape that conforms to an outer perimeter surface of the ring platform.

A primary benefit of the present disclosure is that the user can change between different components, i.e., the setting can be altered.

Another advantage associated with this disclosure is the ease in changing from one ring style to a different ring style.

Still another benefit is the ease in which the change can be made.

Yet another advantage resides in the resulting rattle-free structure.

Benefits and advantages of the present disclosure will become more apparent from reading and understanding the following detailed description

DETAILED DESCRIPTION

Figure 1:
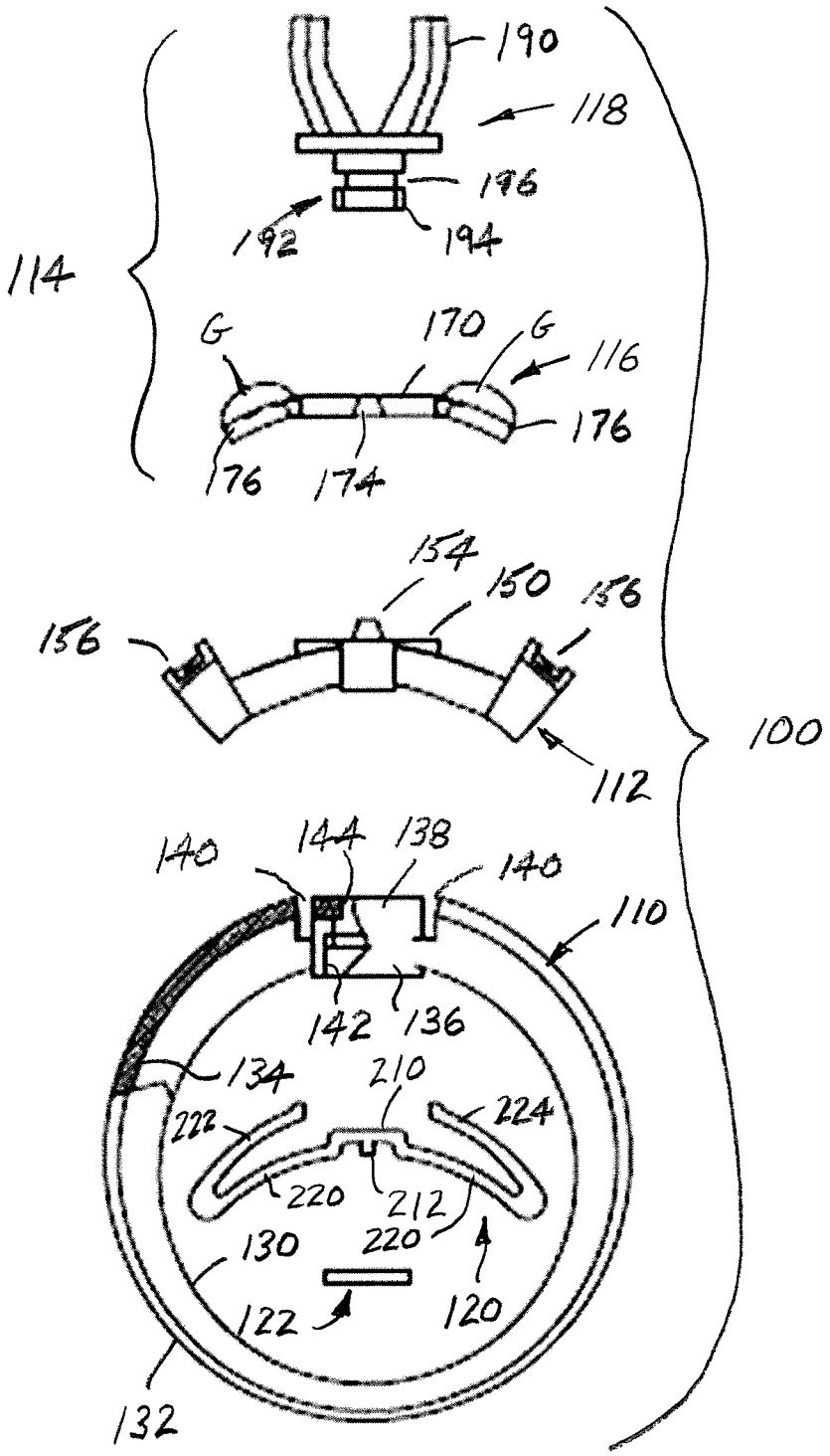
FIG. 1 is an exploded view of the disassembled components of the subject ring assembly.
Figure 2:
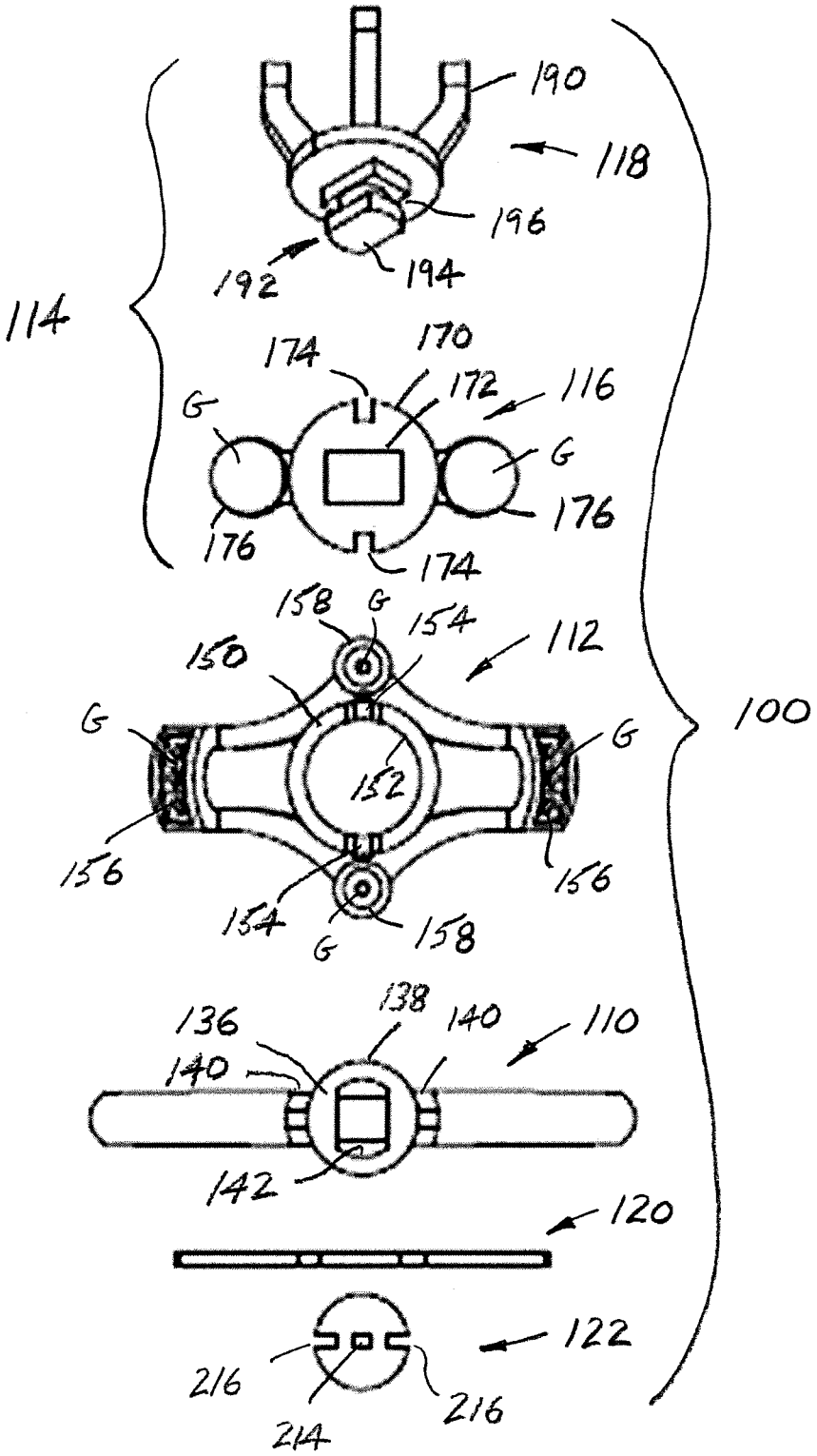
FIG. 2 is another exploded view of the disassembled components of FIG. 1.
Figure 3:
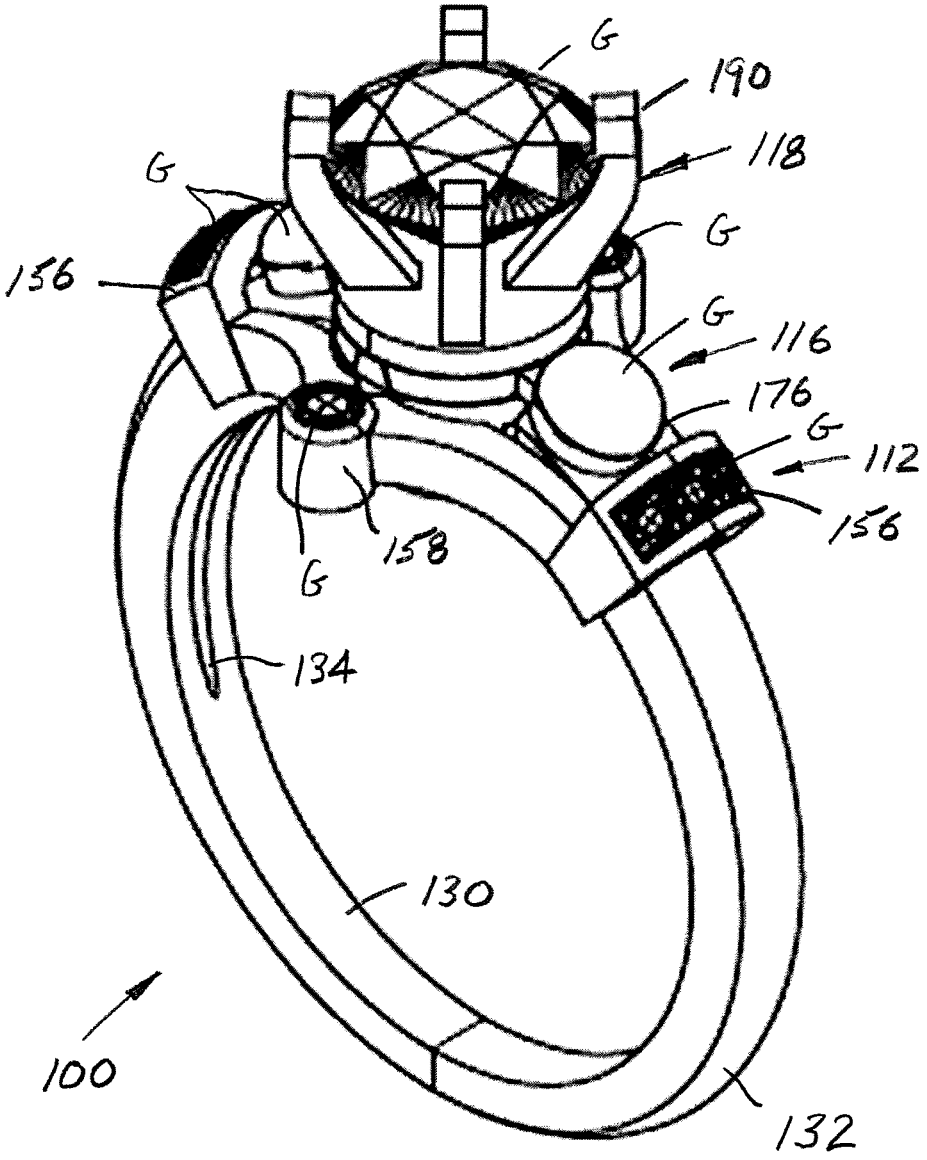
FIGS. 3-8 are respective perspective, front, cross-sectional, side, cross-sectional, and top views of the assembled ring assembly.
Figure 4:
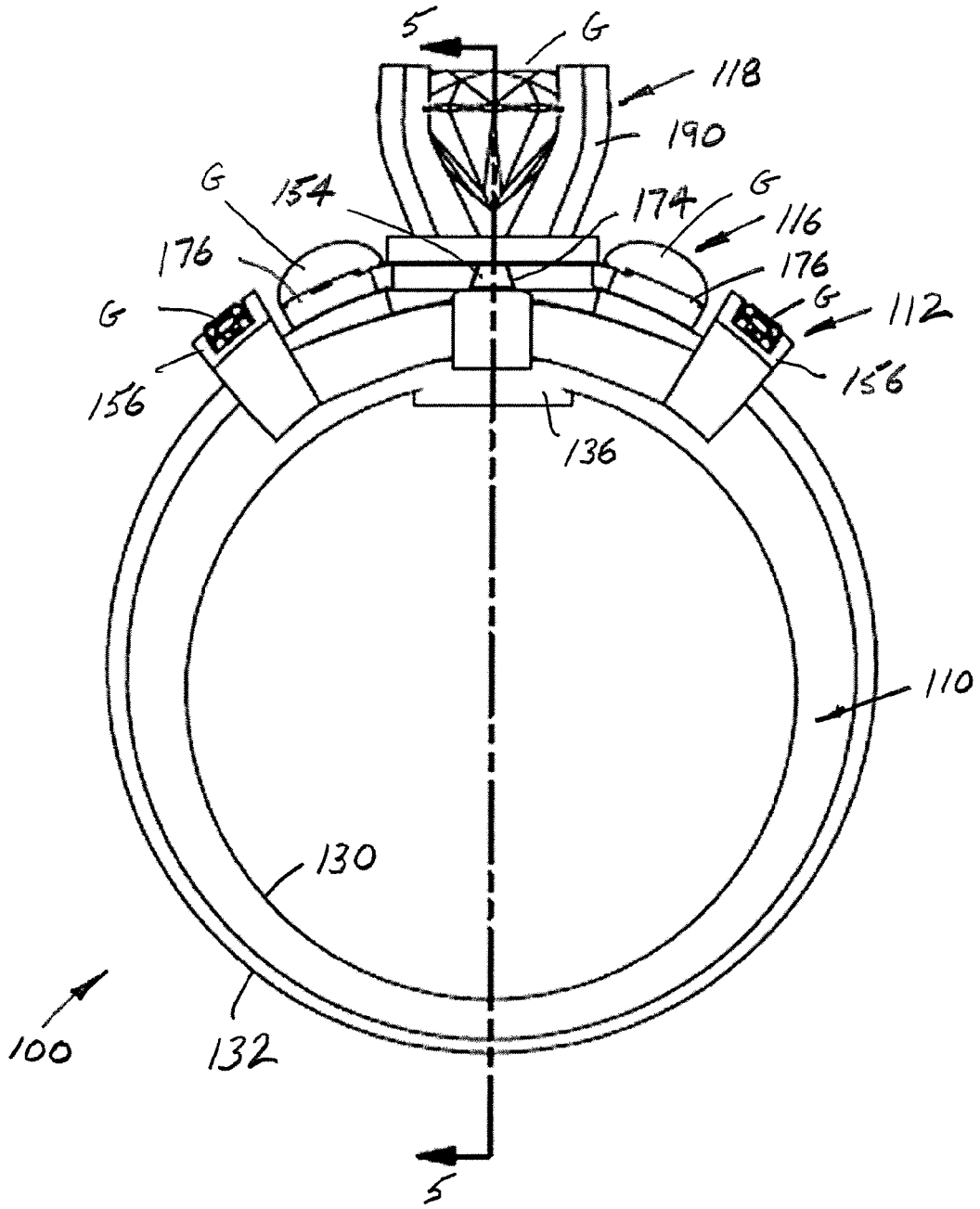

Turning to FIGS. 1 and 2, a ring assembly 100 includes a ring platform 110, and arc-shaped collar 112, an ornament portion 114 that in the preferred arrangement includes two separate components, namely, a shoulder ornament portion 116 and a head portion 118, a biasing spring 120, and a base plate 122. These components shown separated in FIGS. 1 and 2 are assembled to create the ring assembly 100 shown in a final, assembled arrangement illustrated in FIGS. 3-6. Specifically, the ring platform 110 is an annular structure having an inner perimeter or circumference 130 and an outer perimeter or circumference 132 (FIG. 1). The inner and outer circumferences 130, 132 need not be concentric, i.e., an annular thickness of the ring platform 110 may vary as the ring platform extends in a circumferential direction. An upper, left quadrant illustrated in FIG. 1 is shown in cross-section, and as is also evident in FIG. 3, and illustrates that a portion of the ring platform 110 includes a recess or pair of recesses 134 that extend over a limited arcuate portion of the inner circumference 130. In addition, a column 136 is centrally located between the recesses 134. The column 136 includes a circular outer surface 138 that is spaced from a remainder of the outer circumference 132 of the ring platform by slots 140 (FIG. 1). Further, the column 136 has a through opening 142 that has varied dimensions as the opening proceeds radially inward toward the inner circumference 130 of the ring platform 110. A radial outer portion of the opening 142 has a generally rectangular configuration in which a length dimension is greater than a width dimension. The width dimension is also shown in FIG. 2 as having a slightly rounded conformation. A first step or shoulder 144 (FIG. 1) forms a first undercut that is adapted to engage head 118 in a manner to be described further below.

Collar 112 extends over a limited arcuate portion of the ring platform 110. As evident for example in FIGS. 3 and 6, the collar 112 has a generally U-shaped dimension for receipt over the ring platform. The collar 112 includes a centrally located sleeve 150 that has an interior opening 152 (FIG. 2) dimensioned for receipt over the column 136 of the ring platform 110. In addition, projections 154 (FIGS. 1, 2, and 4) extend generally radially outward at circumferentially spaced locations from the sleeve 150 of the collar 112. In this particular embodiment, first and second projections 154 extend upwardly from diametrically opposite locations on the sleeve 150, although it is contemplated that the projections could be provided at alternate locations if so desired. As perhaps best evident in FIG. 1, each projection 154 has a generally truncated conical shape. Further, the collar 112 includes mounts shown here as a pair of mounts 156 located at substantially opposite ends of the collar and a pair of mounts 158 located on opposite sides of the collar. The mounts 156, 158 may be used to secure gemstones G or the like therein in a manner well known in the art.

Ornament portion 114 includes the shoulder ornament 116 that may be a separate component or joined to the head 118. Separate components that are subsequently joined together provide a greater variety of styles when different styles are desired and one or both of the shoulder ornament 116 and head 118 are altered. The ornament portion 114 includes a central, annular portion 170 having an opening 172 (FIG. 2) that is preferably rectangular shaped (i.e., a length dimension is greater than a width dimension). There is also provided first and second recesses 174 at diametrically opposite locations that have a tapered shape (FIGS. 1 and 4) that selectively receive the projections 154 of the collar 112 in a manner to be described further below. In addition, mounts 176 may be provided at opposite ends of the shoulder ornament to secure gemstones or other decorative elements therein.

The head 118 includes fingers or retaining prongs (or a bezel) 190 extending upwardly that together retain a gemstone G in a conventional manner. Extending in the opposite direction or downwardly is an anchor 192. The anchor 192 includes a first foot portion 194 (FIG. 2) that as a generally rectangular conformation, i.e., a length dimension greater than a width dimension. Here, the longitudinal sides extend parallel to one another and the width dimension has a slightly rounded contour for receipt through the similarly shaped opening in column 136 of the ring platform 110. As will be appreciated, the first foot portion 194 passes through the opening 172 in the shoulder ornament portion 116, and also passes through the opening 152 in the sleeve 150 of the collar 112, prior to receipt through the similarly shaped opening 142 in the column 136 of the ring platform 110. Once the first foot portion 194 of the anchor 192 passes beneath shoulder 144 in the column 136, a reduced dimension portion 196 (FIGS. 1-2) of the anchor 192 allows the first foot portion to be rotated 90° for engagement beneath the shoulder to prevent upward removal of the head 118 from the ring platform 110.

Figure 5:
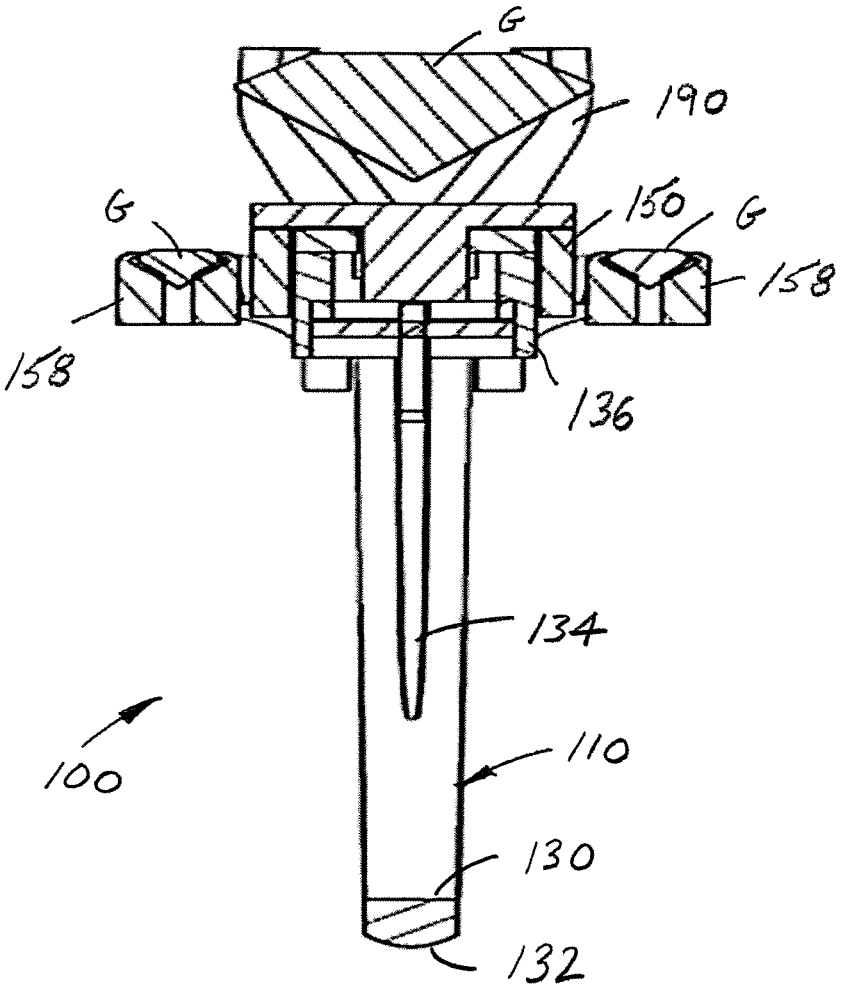
Figure 6:
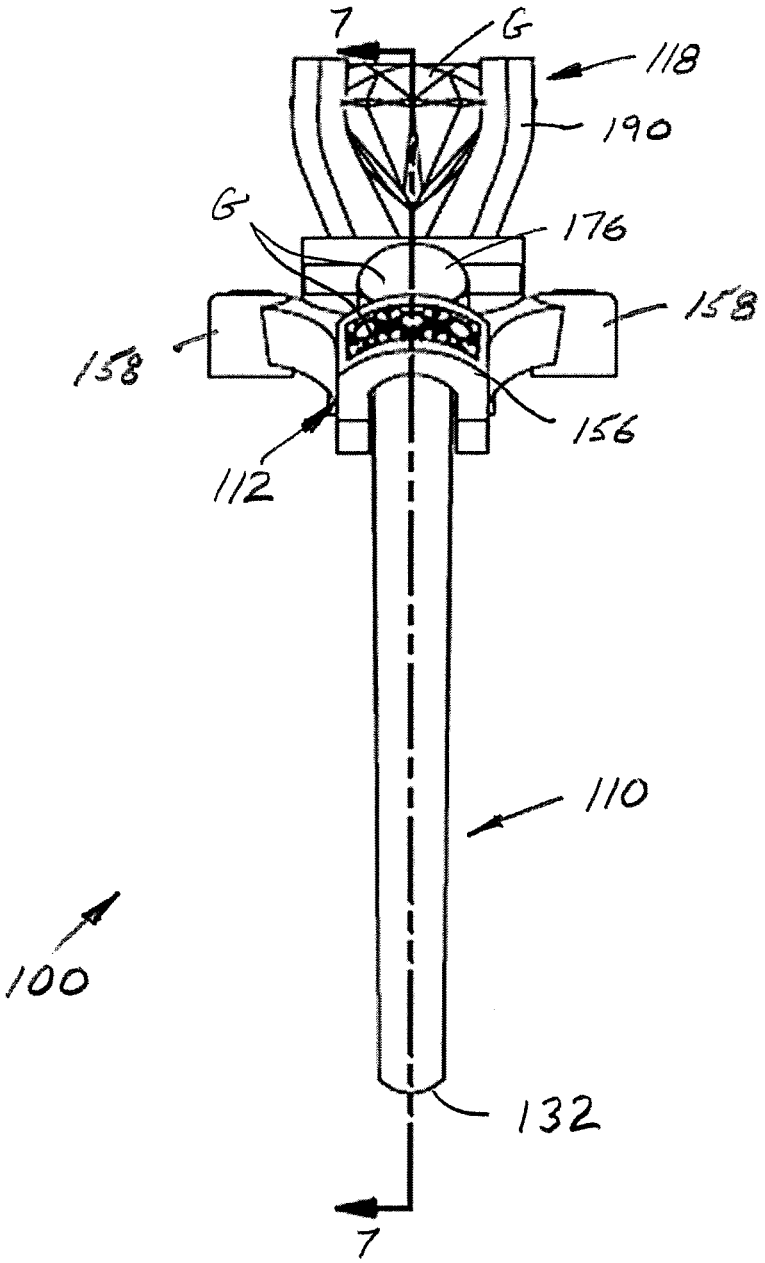
Figure 7:
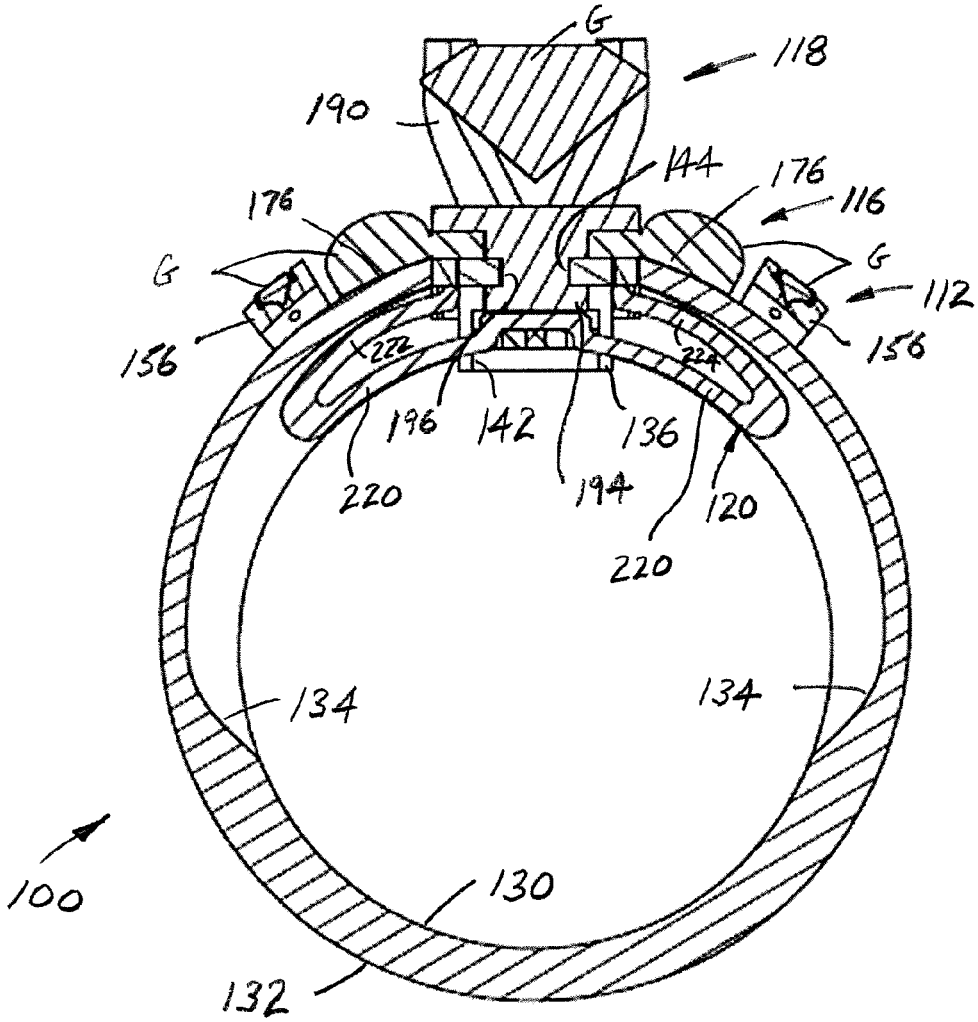
Figure 8:
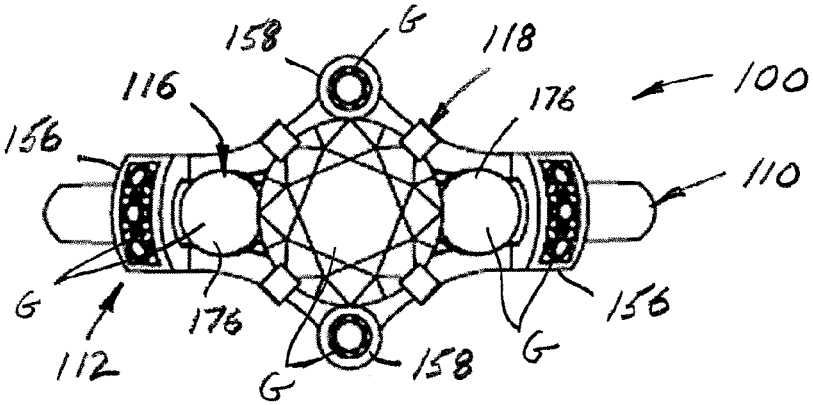

Spring 120 is secured to base plate 122 and an inner circumferential region of column 136 of the ring platform 110. More particularly, a central portion 210 of the spring 120 includes a pin 212 (FIG. 1) received in corresponding opening 214 (FIG. 2) in the base plate 122. Pin 212 is welded into opening 214 in a preferred arrangement, for example where the pin 212 and the ring platform 110 are made of the same or compatible materials (e.g. stainless steel) allowing the materials to be fused or welded. Of course, it is also contemplated that other matters/methods of joining these components could be alternately used. For instance, the assembly could be joined by a bezel into an inner circumferential region of the column 136 of the ring platform 110, or the components could be joined by a friction fit. The base plate 122 and central portion 210 of the spring 120 may be welded or otherwise joined to an inner circumferential region of the column 136 of the ring platform 110. A pair of diametrically opposite grooves 216 are provided on the base plate 122 and dimensioned to receive portions of the spring 120 therein, particularly first arcuate portions 220. The first arcuate portions 220 extend outwardly in opposite directions from the central mounting portion 210, and second and third arcuate portions 222, 224 are cantilever mounted to opposite ends of the first arcuate portions. Terminal ends of the second and third arcuate portions 222, 224 (FIG. 1) extend outwardly through the slots 140, respectively, formed on opposite sides of the column 136 in the ring platform 110 for abutment with the underside of the collar 112 (as will be described further below). The arcuate portions 220, 222, 224 are dimensioned for receipt in the recesses 134 of the ring platform 110 (FIGS. 5 and 7).

Figure 9:
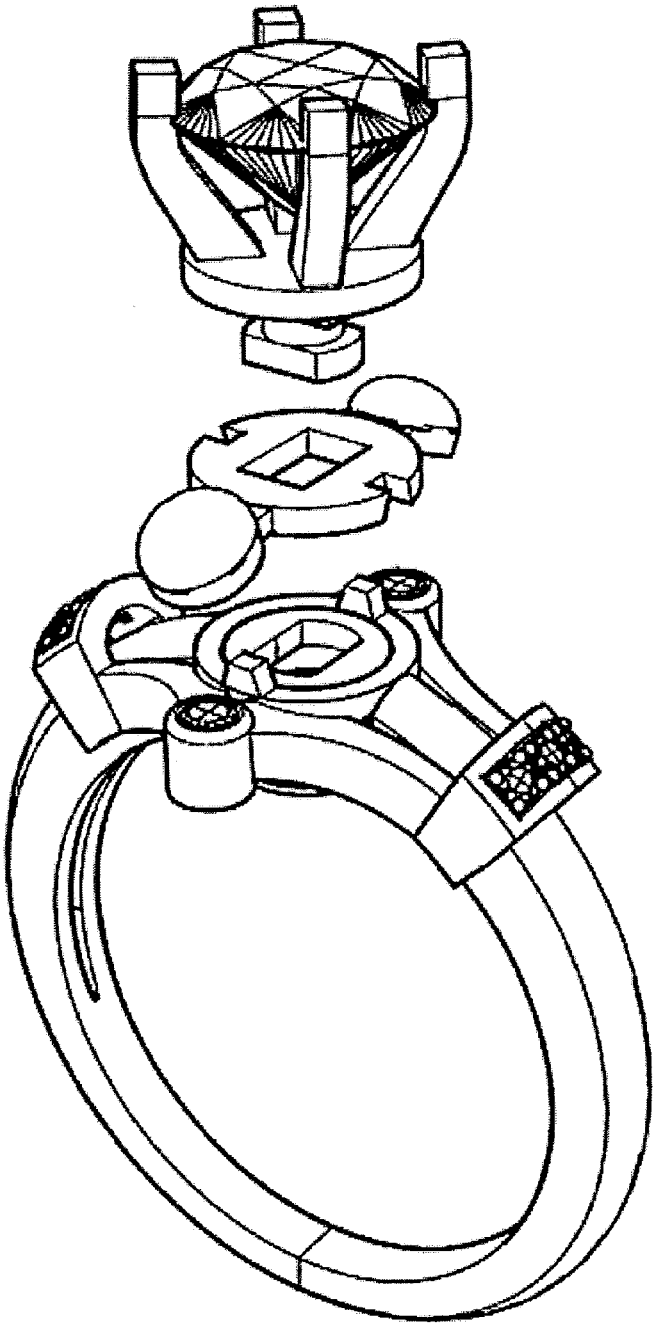
FIGS. 9-17 are perspective views illustrating sequential steps of assembling the components to create the ring assembly of FIGS. 3-6.
Figure 10:
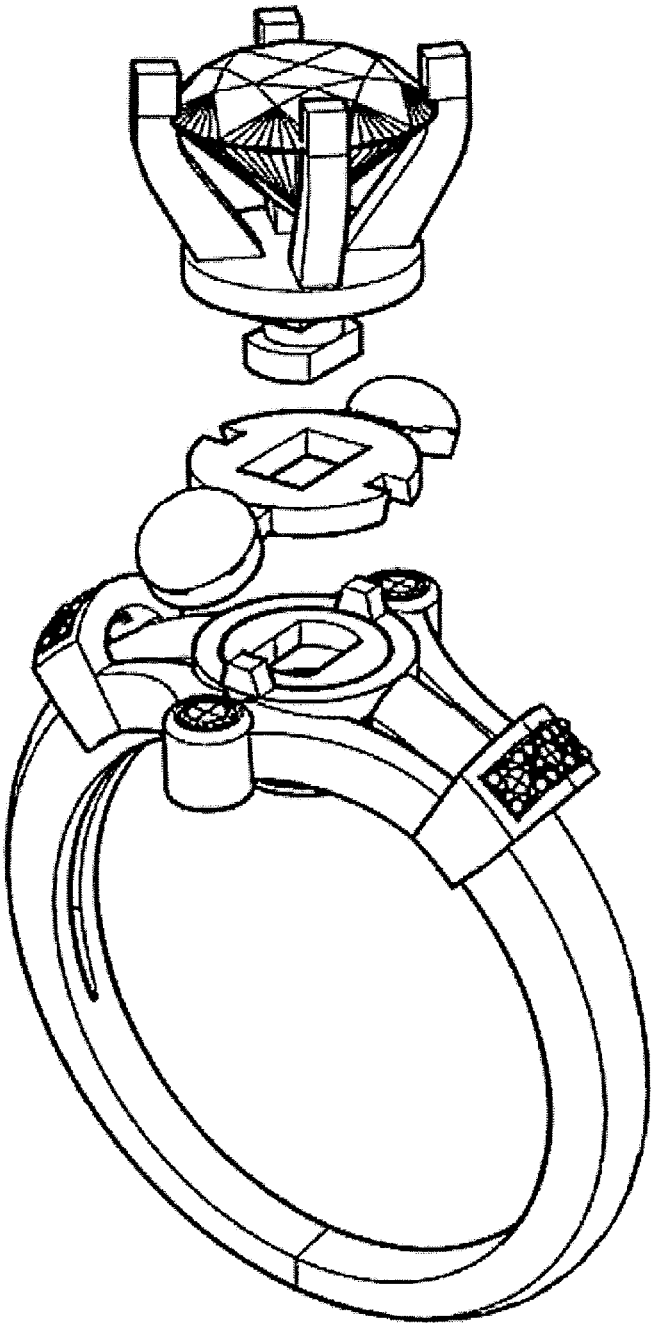
Figure 11:
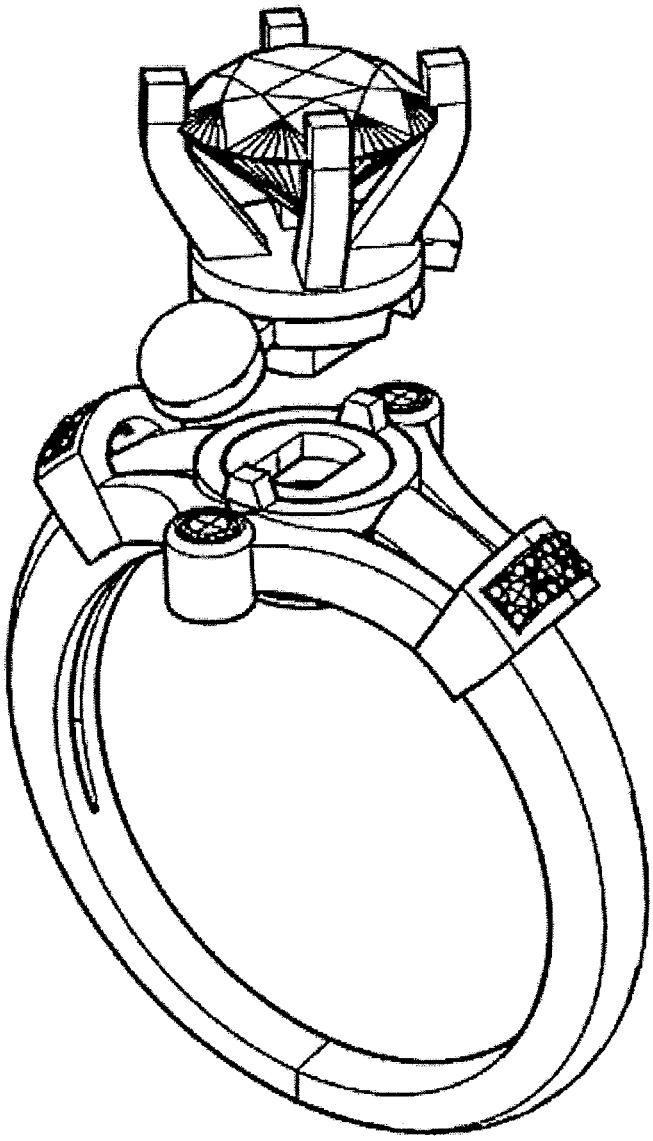

FIGS. 9-17 are progressive views of the assembly of the ring assembly 100 described above. Particularly, in FIG. 9, the spring 120 has already been joined to the base plate 122, the collar 112, and the ring platform 110. The shoulder ornament portion 116 is oriented so that rectangular opening 172 therethrough is aligned with the rectangular opening 142 in column 136 of the ring platform 110. The head portion 118 is shown in FIG. 9 as being 90° out of phase (non-aligned) relative to the ornament portion 114. Specifically, the first foot portion 194 has a rectangular conformation also so that the head portion 118 is rotated until the first foot portion can pass through the aligned openings 172, 142 in the shoulder ornament portion 116 and ring platform 110, respectively. Thus, the rotation or alignment of the head portion 118 is progressively illustrated in FIGS. 9, 10, and 11. It will be appreciated that the head portion 118 may be first joined to the shoulder ornament portion 116 as represented in FIG. 11 by aligning and advancing the first foot portion 194 through the opening 172 in the shoulder ornament portion to form the ornament portion 114.

Figure 12:
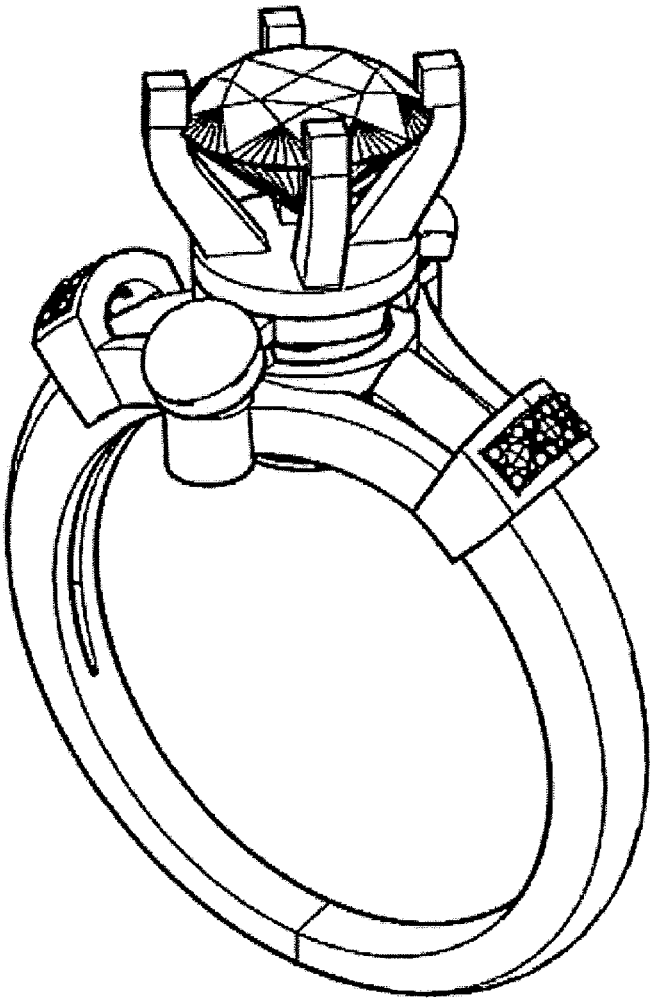

This subassembly (ornament portion 114) is then the axially advanced toward the other subassembly (comprised of the joined spring 120, base plate 122, collar 112, and ring platform 110) as shown in FIGS. 11 and 12. The ornament portion 114 presses downwardly on the projections 154 that extend upwardly from the collar 112. Further axial advancement of the ornament portion 114 subassembly is precluded until the 1$^{st}$ foot portion 194 passes entirely through the opening 142 in the column 136 of the ring portion. The spring 120 exerts an upward force or bias on the collar 112 as a result of the arcuate portions 222, 224 extending through the slots 140 in the ring platform 110. The arcuate portions 222, 224 flex downwardly relative to the mounted central portion 210 of the spring to accommodate the downward pressure exerted by the ornament portion subassembly 114.

Figure 13:
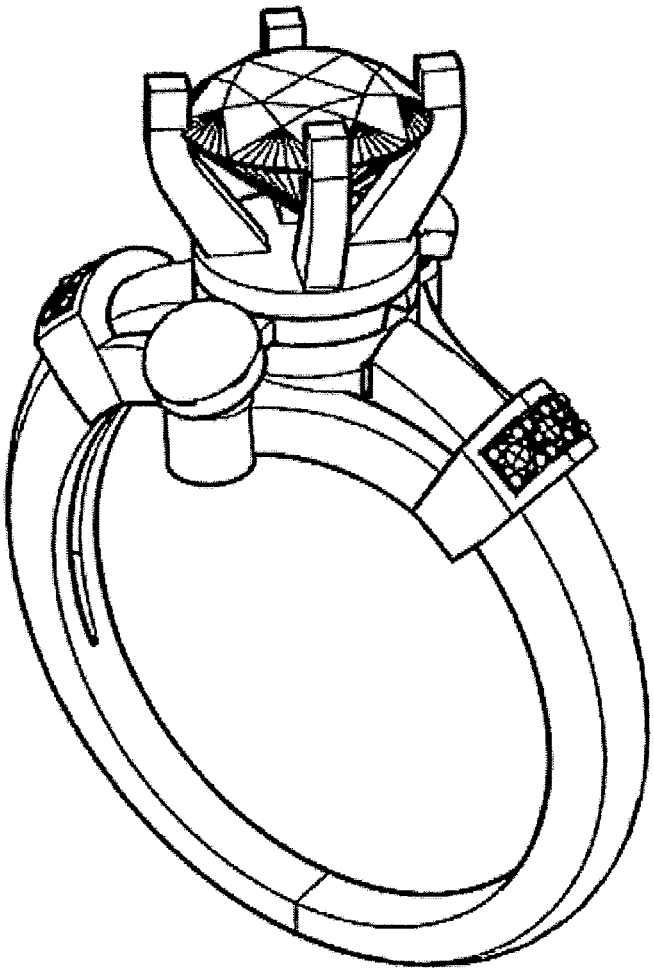
Figure 14:
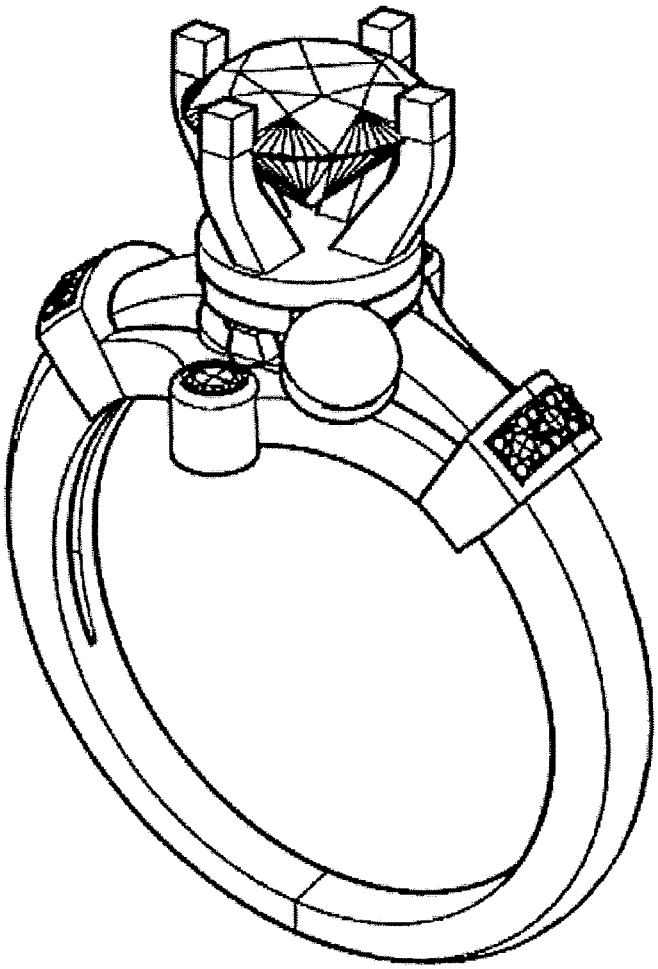
Figure 15:
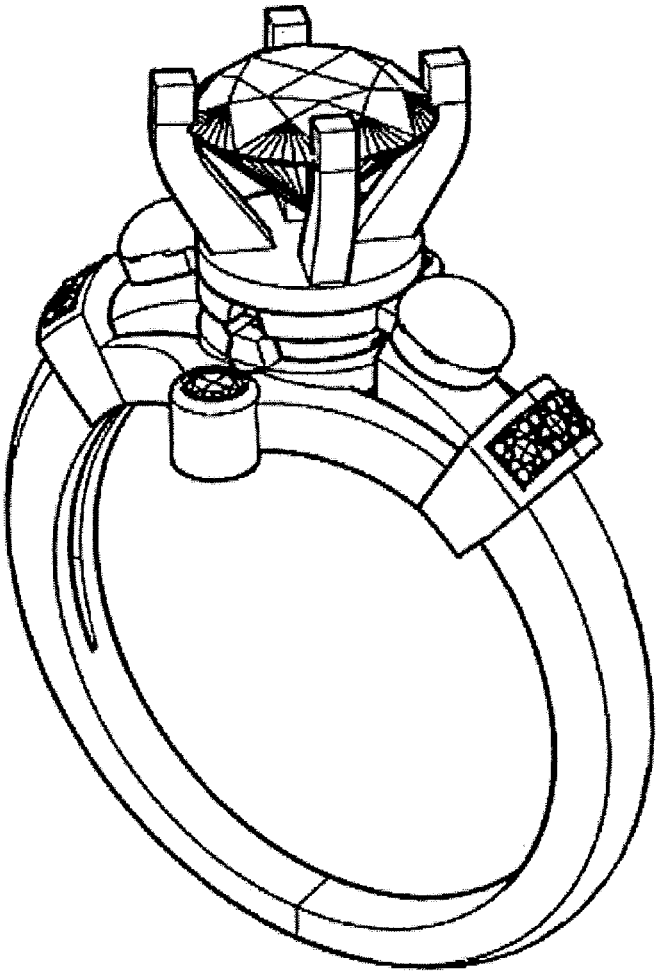
Figure 16:
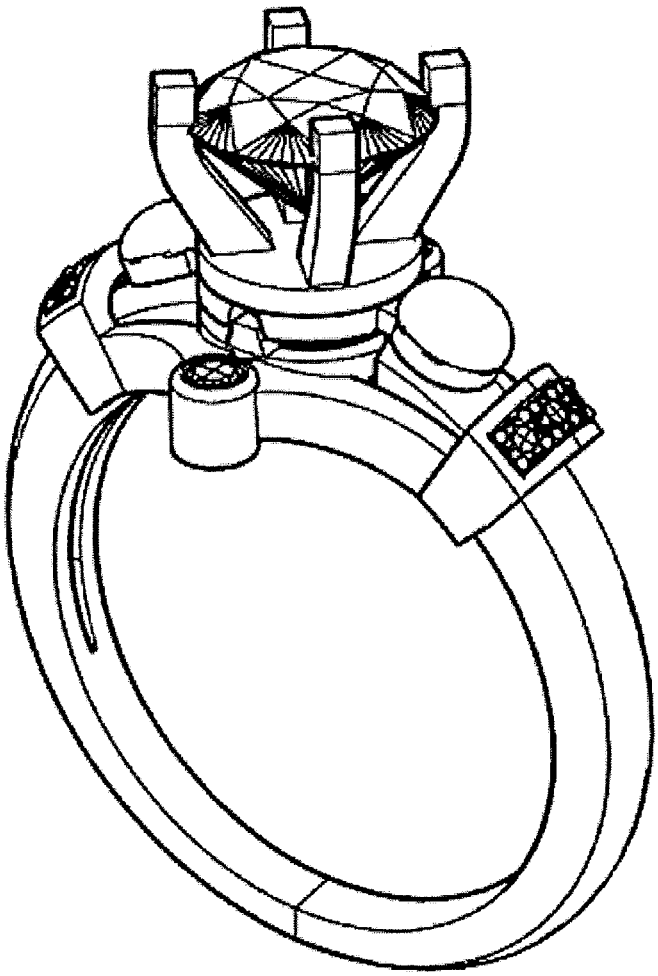
Figure 17:
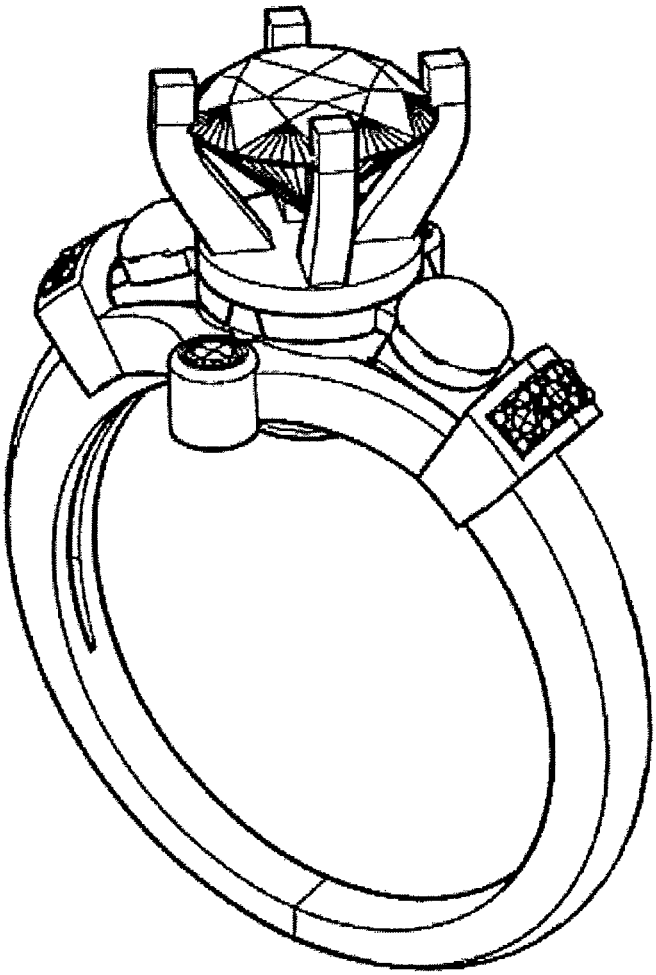

While maintaining the downward force and depressing the arcuate portions 222, 224 of the spring, the ornament portion subassembly 114 is then rotated through 90° as progressively illustrated in FIGS. 13 and 14, and the final position of FIG. 15. Once the ornament portion subassembly has been rotated through 90°, the projections 154 in the sleeve 150 of the collar 112 are aligned with and received in respective first and second recesses 174. This allows the ornament portion subassembly 114 to be urged upwardly where the projections 154 of the collar 112 advance into the matingly shaped recesses (e.g., generally truncated conical shape) that locks the subassemblies together under the biasing force of the spring (FIG. 17).

Figure 18:
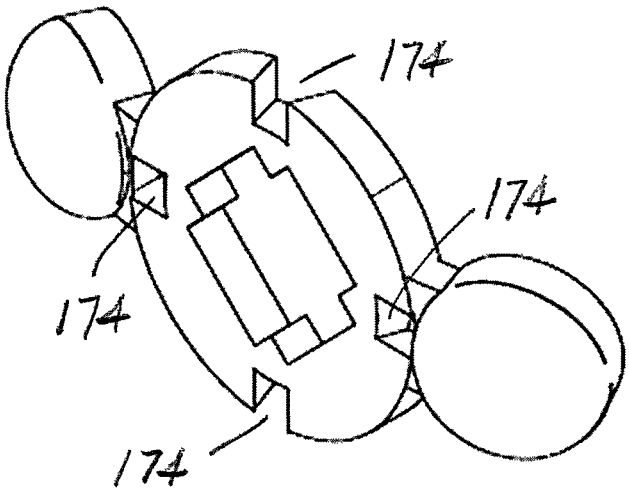
FIGS. 18-20 are perspective, plan and side views of an alternate ornament portion.
Figure 19:
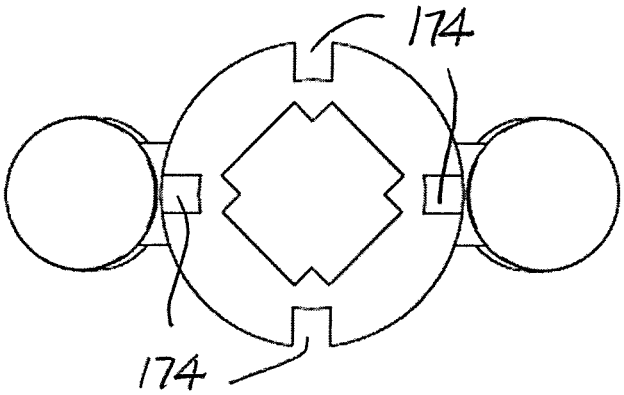
Figure 20:
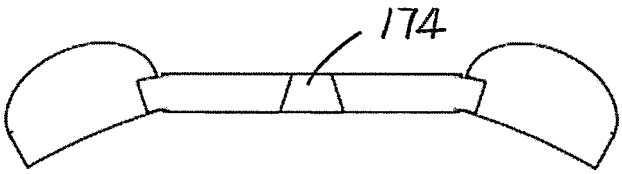

One skilled in the art will appreciate that additional projections (similar to projections 154) and recesses (similar to recesses 174) could be provided to allow selective rotational indexing of the components and thereby display additional, various shoulder ornaments as desired (FIGS. 18-20). In substantially all other aspects, the variation of FIGS. 18-20 operates in the same manner as that described above.

Figure 21:
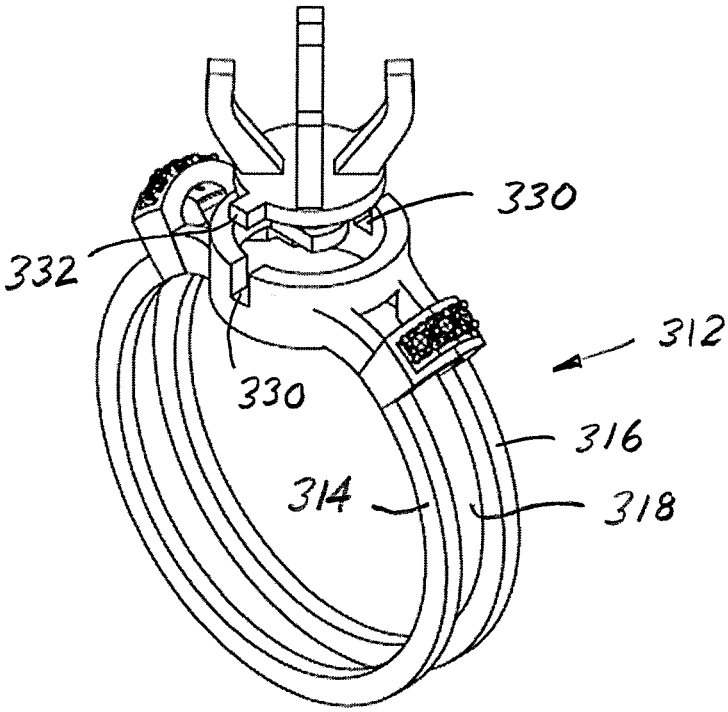
FIGS. 21-26 are various views of an adjustable ring size assembly.
Figure 22:
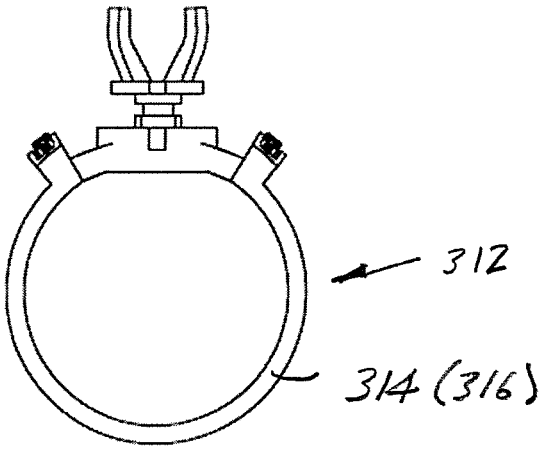
Figure 23:
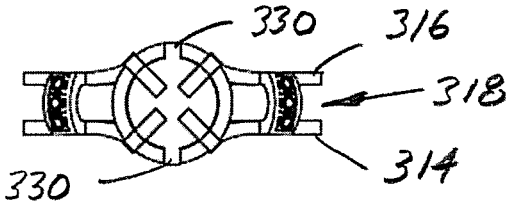
Figure 24:
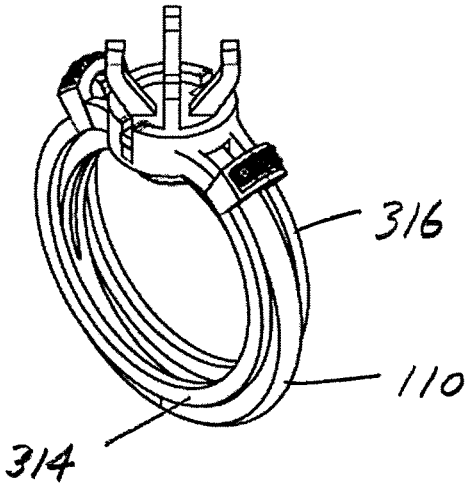
Figure 25:
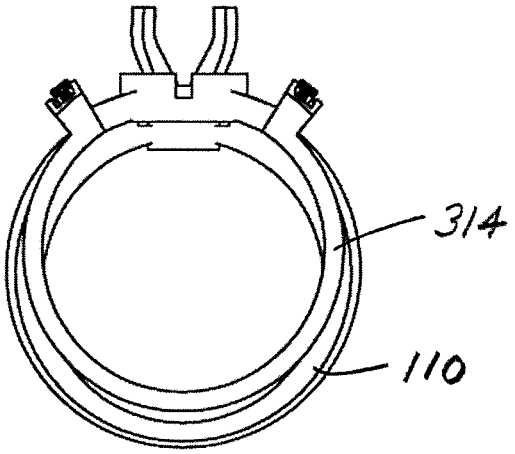
Figure 26:
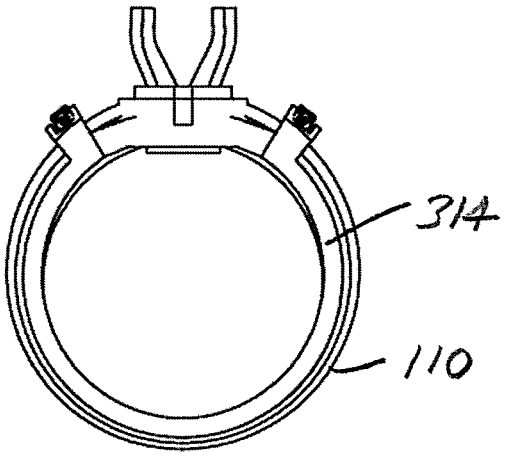

FIGS. 21-26 illustrate modifications to the assembly. As shown in FIGS. 21-23, collar 312 is modified to include spaced apart, first and second annular portions 314, 316 that form a gap 318 that extends over a part of the circumference. The annular portions 314, 316 receive the ring platform 110 of the type generally shown and described above with respect to the embodiments of FIGS. 1-17. The ring platform 110 is advanced into the gap 318 between the first and second annular portions 314, 316 of the modified collar 312. This gap 318 allows the ring platform 110 to vary its position relative to the collar 112 so that ring size can be varied (compare the assembly of FIG. 25 for a smaller finger with the assembly of FIG. 26 which accommodates a larger finger). The bias of the spring 120 allows the modified collar 312 and the ring platform 110 to slide vertically under spring tension and yet remain assembled and locked.

Also of particular note is the extent that the ring head portion 118 extends above the sleeve portion 150 of the modified collar 112. Again, the collar and the ring platform can slide vertically under spring tension, and yet remain assembled and locked against relative rotation with respect to one another. This is achieved as a result of the sleeve portion 150 of the modified collar 312 including slots 330 (instead of the truncated projections 154 of the embodiment of FIGS. 1-8). The slots 330 on the collar receive projections 332 (only one projection 332 is shown in FIG. 21) extending outwardly from the head portion 118.

This written description uses examples to describe the disclosure, including the best mode, and also to enable any person skilled in the art to make and use the disclosure. The patentable scope of the disclosure is defined by the claims, and may include other examples that occur to those skilled in the art. For example, the second projection on the anchor 192 which meets with opening 172 could be made sufficiently thick in order to stack multiple ornamental shoulder assemblies 116. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A ring assembly comprising:

an annular ring platform having a recess formed in a portion thereof and a column with an opening therein;

a collar received on the ring platform and having a sleeve that mates with the column;

an ornamental portion having an anchor that extends through the collar and selectively mates with the column opening; and a biasing spring including a central portion and first portions extending outwardly therefrom and disposed on opposite sides of the column of the ring platform, the biasing spring central portion being centrally mounted to the column, and the spring includes second and third portions that are arcuate and are cantilever mounted to opposite ends, respectively, of the first portions, the spring at least partially received in the recess of the ring platform, the ornamental portion selectively rotatable relative to the ring platform whereby the anchor locks with the column and the spring urges the ornamental portion toward locked relation therewith, wherein terminal ends of the arcuate, second and third portions of the spring extend outwardly through slots formed on opposite sides of the column in the ring platform.

2. The ring assembly of claim 1 wherein the ornamental portion includes a shoulder ornament portion and a head portion.

3. The ring assembly of claim 2 wherein the shoulder ornament portion includes an opening that is similarly shaped to a perimeter configuration of the anchor.

4. The ring assembly of claim 3 wherein the shoulder ornament portion includes a recess that selectively receives a projection extending outwardly from the collar.

5. The ring assembly of claim 4 wherein the shoulder ornament portion and the collar rotate together when the projection is received in the recess.

6. The ring assembly of claim 5 wherein the anchor includes a foot portion spaced by a reduced dimension portion, whereby the foot portion selectively engages the column.

7. The ring assembly of claim 1 wherein the anchor has a generally rectangular perimeter conformation in which a length dimension is greater than a width dimension.

8. The ring assembly of claim 7 wherein the column opening has a generally rectangular perimeter in which a length dimension is greater than a width dimension that the anchor extends therethrough only when the length dimensions are aligned with one another.

9. The ring assembly of claim 1 wherein the collar has a U-shaped cross-section that is dimensioned and configured in a widthwise direction for receipt over the outer surface of the ring platform.

10. The ring assembly of claim 1 wherein the collar has an arcuate shape that conforms is configured to a circumferentially extending portion of an outer perimeter surface of the ring platform.

11. The ring assembly of claim 1 wherein the collar includes first and second annular portions forming a gap that receives the annular ring platform.

12. A ring assembly comprising:

an annular ring platform having a recess formed in a portion thereof and a column with an opening therein;

a collar received on the ring platform and having a sleeve that mates with the column;

an ornamental portion having an anchor that extends through the collar and selectively mates with the column opening; and a biasing spring including a central portion and first portions extending outwardly therefrom and disposed on opposite sides of the column of the ring platform, the biasing spring central portion being centrally mounted to the column, and the spring includes second and third portions that are arcuate and are cantilever mounted to opposite ends, respectively, of the first portions, wherein the spring first portions and the arcuate, second and third portions are dimensioned for at least partial receipt in the recess of the ring platform and abutting the collar, the ornamental portion selectively rotatable relative to the ring platform whereby the anchor locks with the column and the spring urges the ornamental portion toward locked relation therewith, wherein the recess is a pair of recesses each extending over a limited arcuate portion of the ring platform and that receive first and second portions, and first and third portions, respectively, of the spring.

* * * * *